US006655954B2

(12) United States Patent
Dane

(10) Patent No.: US 6,655,954 B2
(45) Date of Patent: Dec. 2, 2003

(54) GAS BURNER AND COOKING APPARATUS USING SUCH A BURNER

(75) Inventor: Bernard Dane, Montbazon (FR)

(73) Assignee: Sourdillion, Veigne (FR)

( * ) Notice: Subject to any disclaimer, the term of this patent is extended or adjusted under 35 U.S.C. 154(b) by 144 days.

(21) Appl. No.: 09/970,310

(22) Filed: Oct. 3, 2001

(65) Prior Publication Data

US 2002/0039713 A1 Apr. 4, 2002

(30) Foreign Application Priority Data

Oct. 3, 2000 (FR) ..... 00 12619

(51) Int. Cl.[7] ..... F23D 14/62
(52) U.S. Cl. ..... 431/354; 126/39 R; 126/39 E
(58) Field of Search ..... 431/354; 126/39 R, 126/39 E

(56) References Cited

U.S. PATENT DOCUMENTS

| | | | | |
|---|---|---|---|---|
| 2,257,399 A | | 9/1941 | Parker | |
| 2,320,754 A | | 6/1943 | Sherman | |
| 2,344,144 A | * | 3/1944 | Hobson | 126/39 R |
| 6,082,994 A | | 7/2000 | Grandveau et al. | |
| 6,092,518 A | * | 7/2000 | Dane | 126/39 E |
| 6,371,754 B1 | * | 4/2002 | Haynes | 431/354 |
| 6,439,881 B2 | * | 8/2002 | Haynes et al. | 431/354 |
| 6,439,882 B2 | * | 8/2002 | Haynes et al. | 431/354 |

FOREIGN PATENT DOCUMENTS

| | | |
|---|---|---|
| EP | 719982 A | 7/1996 |
| FR | 2049447 | 3/1971 |
| FR | 2776753 | 10/1999 |
| GB | 2240168 A | 7/1991 |
| NE | 31636 | 7/1933 |
| WO | WO 98/15780 | 4/1998 |

* cited by examiner

*Primary Examiner*—Alfred Basichas
(74) *Attorney, Agent, or Firm*—Greer, Burns & Crain, LTD

(57) ABSTRACT

All-gas burner, the shape of the peripheral wall of which is not circular in order to increase the heat exchange surface with the item to be heated. The ejection orifices which cross this peripheral wall are created so as to permit a substantially complete combustion of the gas.

17 Claims, 2 Drawing Sheets

GAS BURNER AND COOKING APPARATUS USING SUCH A BURNER

DESCRIPTION

The present invention relates to a gas burner. It also relates to a cooking apparatus, such as a cooker or a slot-in cooking surface, using this gas burner A fuel, for example a gas, which is injected into a burner enters a first zone where it is mixed with a first volume of combustive agent, for example air, in order to form a so-called "primary" mixture the richness of which exceeds its stoichiometric conditions. This mixture is then conducted into a convergent/divergent system which can in particular be a horizontal venturi, a radial venturi or a vertical venturi, and which we shall henceforth call "venturi". On leaving the venturi the primary mixture enters a recompression chamber surrounded by a peripheral wall of generally circular shape. Orifices are provided through this peripheral wall, orifices through which the primary mixture is ejected into the ambient milieu. The primary mixture is then diluted anew in a combustive agent, for example the ambient air, in order to more or less reach the stoichiometric conditions, that is to say to form a combustible mixture. When the combustible mixture is ignited, it is close to the outlet of the ejection orifices that the flames form.

These known burners have the disadvantage of having radially inside the ring of flames a central zone more or less devoid of heat exchange. This arrangement can be a major drawback when it is desired to cook a foodstuff evenly in a frying pan.

Two solutions have principally been adopted by the prior art to optimize the heat exchange surface, and thus the distribution of the heat at the base of the receptacle.

A first solution is to add at least one peripheral wall concentric to the first peripheral wall and situated in the central zone. However, this technique is expensive and more suited to large kitchens in industry or restaurants. This actually amounts to a practical doubling of all of the items of equipment of the burner, and assists the combustion of the primary mixture emerging from an internal peripheral wall, as this mixture cannot thin in the ambient air, which is not very abundant in the central zone.

A second solution, while retaining the generally circular shape of the burner, involves giving the peripheral wall a shape such that some of its parts extend more or less radially from the centre of the burner towards its periphery. This is the solution presented in documents NL 31636, U.S. Pat. No. 2257399 and U.S. Pat. No. 2320754. These documents are already old and date respectively from 1933, 1938 and 1938. The solutions which they disclose are suited to town gas, that is to say gas made in a factory and mainly used up until the middle of the XXth century. This town gas is essentially methane or hydrogen, that is to say a gas requiring a small supply of air in order to reach stoichiometric conditions. These techniques were abandoned with the use of richer gases such as propane and methane. The latter, having the greater calorific power, are also comprised of longer carbon chains the combustion of which requires a greater supply of air. For the forms of peripheral walls presented in the cited documents, there is little space available for each flame and some of them mingle, which is harmful to combustion.

Apart from the richness of the gases used, standards and customer requirements increase the difficulties encountered. Standards actually impose ever higher combustion rates.

Moreover, customers seek cooking surfaces where the technical aspect is masked by the aesthetic aspect. For example, burners which have a low apparent height and a short distance between the base of a receptacle and the top of the cooking surface. Thus, combustion must be ever improved whereas the volume available for the dilution of the primary mixture with the ambient air is ever smaller.

The aim of the invention is thus to propose a burner capable of significantly increasing the heat exchange surface, satisfying the requirements of the standards in force, and the desires of present customers. The main condition for this is that the flames do not intermingle, that is to say that the primary mixture leaving an orifice of the peripheral wall has enough space to thin in a sufficient quantity of ambient air.

The following definitions will be used in this document. An ejection axis is an axis representing, in the two-dimensional figures on the attached sheets, a plane which is longitudinal and more or less median relative to the ejection orifices. An ejection axis is oriented and originates in the outlet of an ejection orifice and extends towards the outside of the burner. In the case of two converging ejection orifices, the convergence distance of an orifice is the distance separating the origin of the ejection axis of this orifice with the point of intersection from the ejection axes of the two orifices, which for example are neighbouring.

According to the invention, a non-circular burner satisfying the requirements already cited is principally characterized in that the orifices of the peripheral wall are realized such that the ejection axis of any first orifice diverges from the ejection axis of a second orifice closest to the first orifice. This definition does not stop another orifice next to the first orifice from converging with the first orifice, but then the convergence distance must guarantee sufficient diffusion.

According to another preferred feature of the invention, no ejection axis is directed towards a part of the peripheral wall, a part which could limit the available space. In order to optimize the heat exchange surface the peripheral wall can also be partly concave.

A burner according to the invention is intended in particular for domestic use. It is thus advantageous that it can be easily cleaned. To this end, the peripheral wall can be made so that it can be reached at any point of its periphery by at least one finger of one hand. On the other hand, to limit a catalysis phenomenon likely to degrade the enamel of a pan support intended to keep a receptacle above the burner, said peripheral wall can include neutralized segments in its parts close to the pan support. However, as the primary mixture ejected through one of the orifices mixes not at all or little with that ejected through a neighbouring orifice, it may be beneficial for a rapid ignition of the burner to have at least one of the ejection orifices connected to at least one neighbouring ejection orifice by a flame duct. A flame duct can for example connect two neighbouring orifices separated by a neutralized segment.

It is advantageous that the neutralized segments each correspond to a part of a concave zone. Another part of the concave zone can have orifices. Thus the desire to have flames in the zones close to the axis of the burner, but for these flames not to interfere with each other, is cleverly combined with the desire to have zones without flames in order to preserve the pan support.

To further improve combustion, it is advantageous to extend the venturi beyond at least one concave segment of the said peripheral wall.

A burner according to the invention can be an all-gas burner, i.e. one burning the rich gases, such as propane or butane, and the lean gases, such as methane, equally well. It can also be designed to obtain the spiral convection effect disclosed by document WO 96/01572, thanks to the same direction of inclination of the ejection axes relative to the zone of the peripheral wall from which they have respectively issued.

The invention also relates to a cooking apparatus using a burner having any one of the above characteristics. On such an apparatus using N burners, N being a whole number, the said N burners can be arranged along a line which is not necessarily rectilinear, on a working surface of the cooking apparatus such that the general shape of the peripheral wall of at least one of the N burners is the image, through a homothety and a rotation of 360°/N/n, of the general shape of the peripheral wall of at least one of its neighbours on said line, n being a whole number that is not zero. This arrangement can in particular permit improvement of the diffusion of the hot gases resulting from the combustion of the combustible mixture.

Other details and advantages of the invention will emerge from the following description, relating to non-limitative examples. In the attached drawings.

Figure 4:
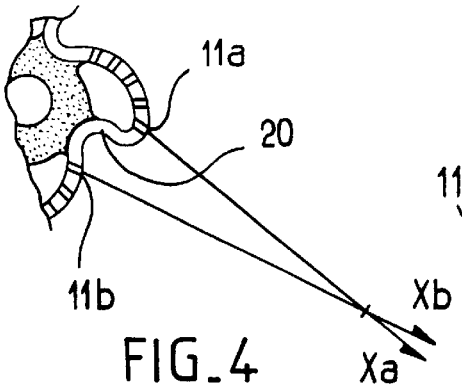
FIG. 4 is a representation of two convergent orifices.

The gas burner 1 comprises a gas injector 5, a mixing chamber 2, a convergence chamber 3 formed vertically in a body 4 of the burner, a divergence chamber 6 which extends radially between the body and a cover 7, then a recompression chamber 8 surrounded by a peripheral wall 9. The peripheral wall is pierced by ejection orifices 11, realized here in the form of slits created in the upper part of the peripheral wall. The cover 7 delimits these orifices above, which are connected to each other by flame ducts 12 created between the upper rim of the peripheral wall and the cover. A venturi (3,6) is formed by the combination of a convergence chamber 3 and a divergence chamber 6, separated by a venturi throat 31.

The gas supplied by the injector 5 is propelled inside the mixing chamber 2 indirection G, more or less in a vertical axis Z of the convergence chamber. In the mixing chamber, the gas starts to mix with the air, called "primary", coming along direction H. The primary mixture thus obtained passes through the venturi to be recompressed in the recompression chamber 8. The major part of the primary mixture is then ejected through ejection orifices 11, the other part being ejected through ducts 12.

A receptacle 14 can be placed above the burner on a pan support 15, a pan support of which only the ends 16 are shown. The receptacle 14 is symbolized by dotted lines in FIG. 5.

Figure 1:
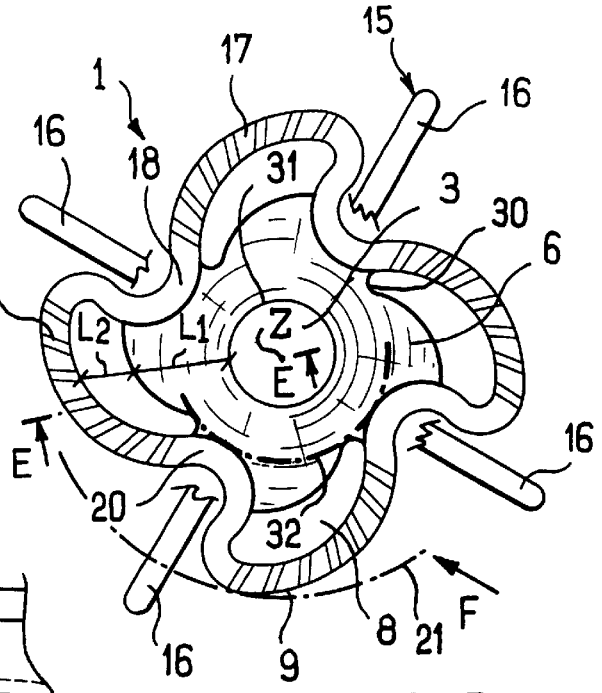
FIG. 1 represents a schematic top view of a first possible type of burner according to the invention.
Figure 2:
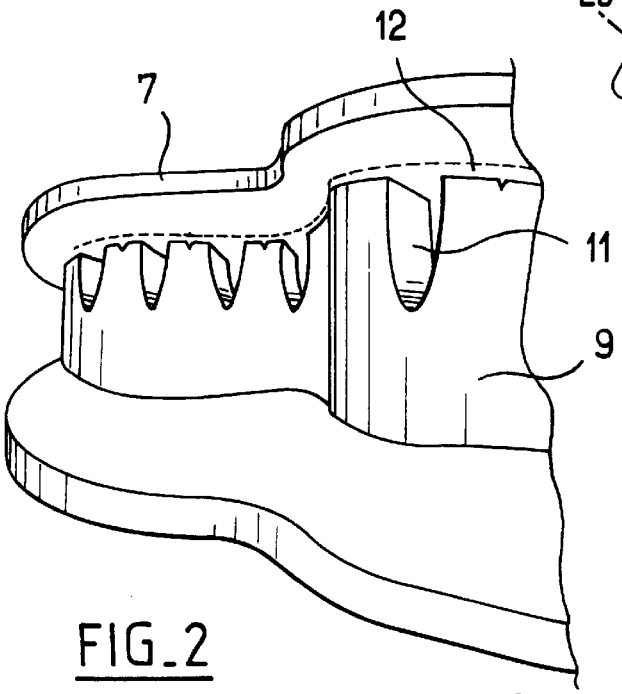
FIG. 2 is a view along F, partial and in perspective, of the burner of FIG. 1.
Figure 3:
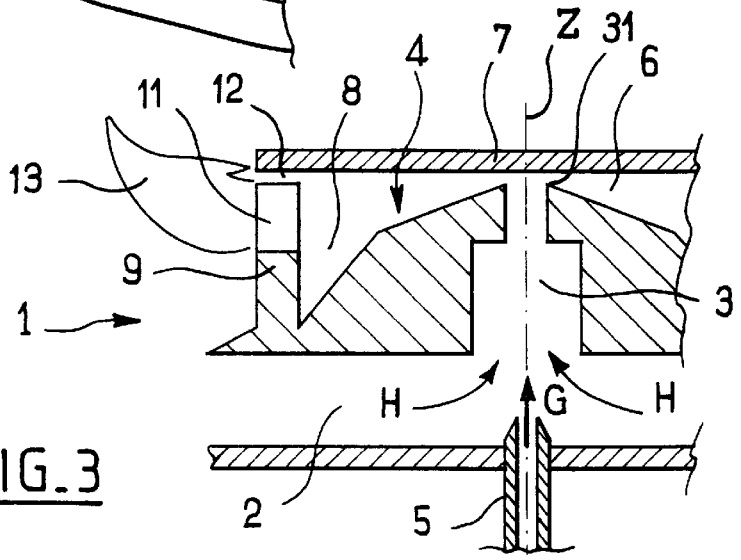
FIG. 3 is a schematic and partial section of a possible burner according to the invention, which can be a section along E—E of the burner of FIG. 1.
Figure 5:
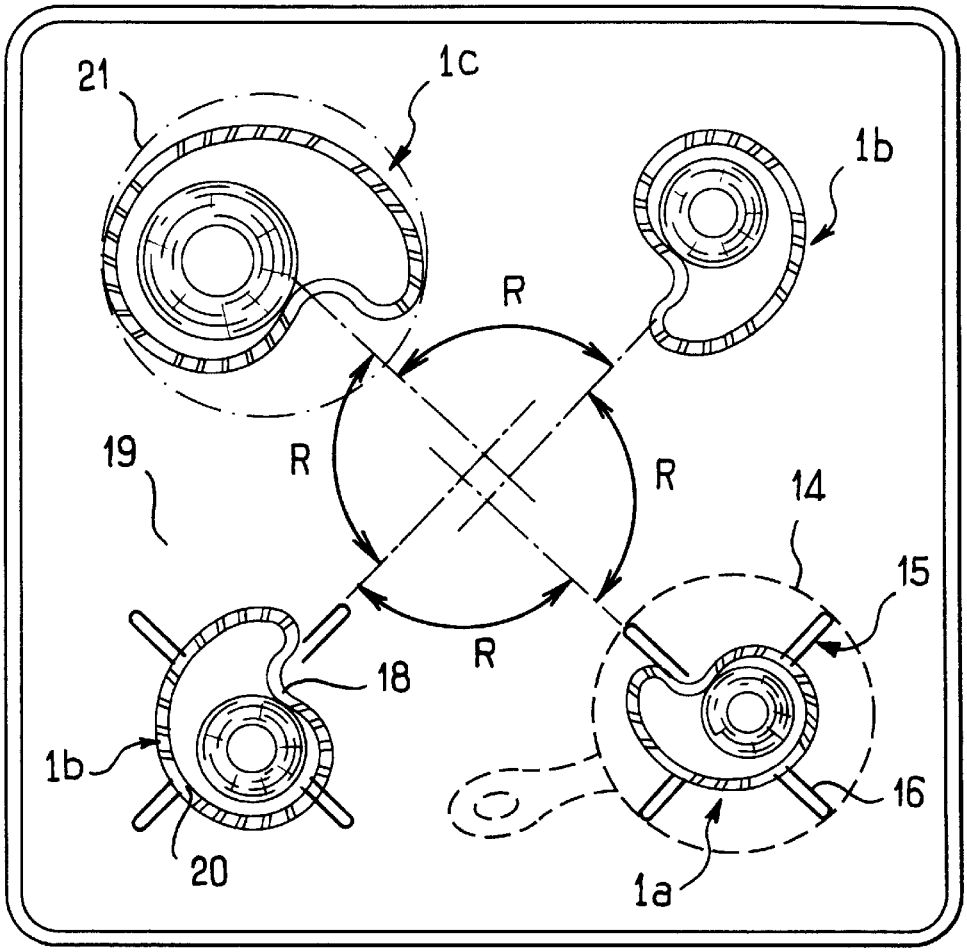
FIG. 5 represents a possible arrangement on a cooking surface of a second possible type of burner according to the invention.
Figure 6:
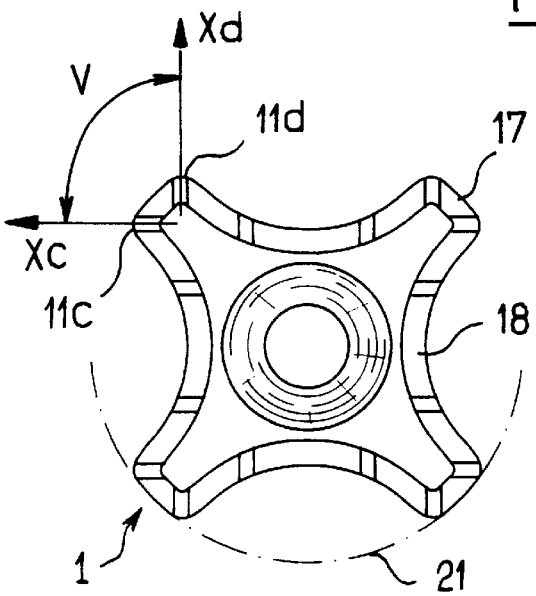
FIG. 6 represents a third possible type of burner according to the invention.
Figure 7:
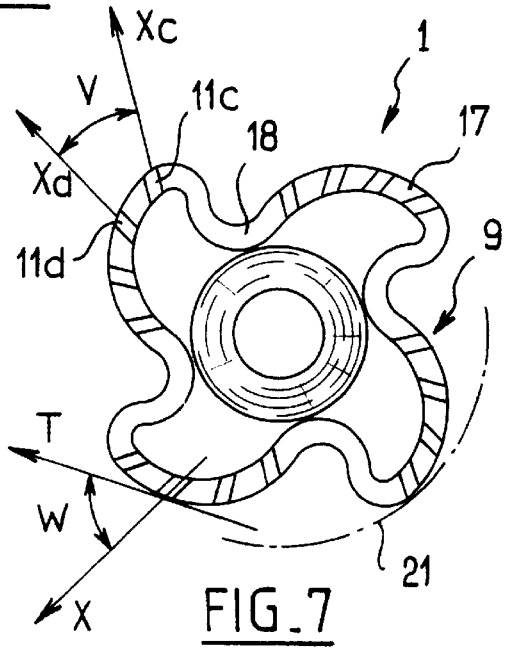
FIG. 7 represents a possible variant of the first type of burner represented in FIG. 1.

In order to substantially increase the contact surface between the flames 13 and the base of the receptacle, thus the heat exchange surface, the peripheral wall is given the shape of a non-circular crown. Thus, the perimeter defined by the peripheral wall is relatively large compared with the minimum diameter of the receptacle 14 that this burner can heat efficiently. According to the invention, the ejection axis Xc of a first orifice 11*c* diverges from the ejection axis Xd of a second orifice 11*d* closest to the first orifice Xc, forming an angle V. Thus, the neighbouring flames diverge relative to each other, and each flame has a sufficient volume despite the length of the peripheral wall which is relatively large compared with the perimeter of the circumscribed circle 21. In the example of FIGS. 1, 6 and 7, the peripheral wall 9 is formed by four lobes 17, each formed by a convex segment of the peripheral wall, separated by concave segments 18. In the example of FIG. 5 the peripheral wall comprises only a single concave segment.

The convex form of the lobes 17 permits, in particular, two orifices pierced in the same convex segment and forming locally, that is to say at their point of piercing, the same angle with the peripheral wall to be made to diverge. Thus, flames that have come from these orifices also diverge, increasing the volume of secondary air available for their combustion, thus the capacity of the burner. This also permits, with divergent orifices of more or less identical diameters following a similar path through the wall, a guarantee of more or less identical pressure drops through each of these orifices.

In order to improve combustion, for the burner of FIG. 1, the divergence chamber 6 of the venturi is extended radially beyond the concave segments 18 of the peripheral wall, contrary to those of the burners of FIGS. 5 to 7. The extension of the divergence chamber actually permits a higher-performance venturi to be obtained.

It is important to create a sufficient recompression chamber between the divergence chamber and the ejection orifices. Without this, the primary mixture is ejected at too great a speed, which risks causing the break-up of the flame which has issued from same and its extinction.

On the other hand, the primary mixture ejected from an orifice that is too far from the divergence chamber has too small a speed. Thus, the flame which has issued from same is too short and the volume which it occupies for its combustion is too small, that is to say the volume of mixture with the secondary air is too small to ensure a good combustion.

For this, it has also been chosen to extend the divergence chamber accordingly as the peripheral wall becomes distant from it, except in the connection zones 30, radially close to the axis Z, where the divergence chamber 6 extends up to the peripheral wall 9. Thus, for each of the orifices of the burner of FIG. 1, for a direct path L1, L2 of the gas between the throat 31 of the venturi and the orifice, comprising a partial path L1 travelled in the divergence chamber and a partial path L2 travelled in the recompression chamber, the two partial paths are each longer when the direct path is longer.

Sufficient space must be reserved for the divergence chamber and the recompression chamber to guarantee an optimal operation of the burner. It has thus been chosen to create burners for which the ratio between the radius of the circumscribed circle 21 and that of a concentric circle 32, inscribed in the peripheral wall, is preferably less than three.

To protect the pan support from the effects of combustion, for example from the risks of catalysis of an enamelled coating of this pan support, neutralized segments 20 not containing an ejection orifice are created along the peripheral wall close to the pan support. The neutralized segments

20 occupy part of the concave zones 18 where an excessive number of orifices could lead to interferences between the flames. These neutralized segments 20 are delimited by a pair of orifices 11*a*, 11*b* which are not neighbouring within the meaning of the invention. The ejection axes Xa, Xb of these orifices can be slightly convergent. This arrangement allows the flames that have issued from these orifices to converge. A substantially regular heating of the periphery of a receptacle is thus assured while creating between these flames a zone, close to the pan support, where combustion is substantially reduced.

The ejection orifices of the burner of FIG. 7 are arranged so that their ejection axis X forms, at the point of exit from each of these orifices, an angle W less than 90° with the tangent T to the peripheral wall.

Like other burners of the prior art, the burners according to the invention can be of several dimensions and more or less homothetic shapes. Each dimension corresponds to a given power, an auxiliary burner 1*a* is low-powered, a semi-fast burner 1*b* is medium-powered, a fast burner 1*c* is high-powered. The burners 1*a*, 1*b*, 1*c* represented in FIG. 5 are integrated in a working surface 19, which can be slotted in or part of a cooking apparatus. They are so arranged that passage from one to its neighbour is moreover at a rotation of angle R=90°.

The invention is of course not limited to the examples described and shown. In particular the equipment of the burner, such as the mixing and recompression chambers or the venturi, can be different or differently arranged; the venturi can, for example, include a vertical instead of radial divergence chamber. The ejection orifices can form slits in the bottom part of the peripheral wall or be drilled through the flank of the latter. The ejection axis may not be in a horizontal plane.

The peripheral wall may not include a concave segment, for example if it has the general form of a square. The angle of the ejection orifices with the tangent to the peripheral wall may be variable along this wall.

The burner according to the invention can of course include accessories that are not shown such as an automatic ignition device or a thermocouple to verify that the primary mixture is actually in the course of combustion.

What is claimed is:

1. A burner comprising:

a non-circular peripheral wall and orifices provided through said wall in order to eject a primary gaseous mixture along an ejection axis associated with each orifice, said orifices are arranged so that the ejection axis of any first orifice diverges from the ejection axis of a second orifice closest to said first orifices;

a venturi including an annular radial divergence chamber which is defined by a throat;

a recompression chamber for recompressing a primary gaseous mixture, said chamber being defined between said divergence chamber and said peripheral wall of said burner; and a direct path of said primary gaseous mixture defined between said throat of said venturi and an orifice, said direct path comprising a first partial path through said divergence chamber and a second partial path through said recompression chamber, wherein said first and second partial paths are each longer when said direct path is longer.

2. The burner according to claim 1, wherein a ratio between a radius of a circle circumscribed at said peripheral wall and a radius of a circle inscribed in said peripheral wall is less than three.

3. The burner according to claim 1, wherein said peripheral wall contains at least one neutralized segment.

4. The burner according to claim 3, wherein said divergence chamber is extended up to said at least one neutralized segment of said peripheral wall.

5. The burner according to claim 3, wherein said orifices comprise at least one pair of successive slightly covergent ejection orifices separated by a neutralized segment.

6. The burner according to claim 1, wherein said peripheral wall is partially concave.

7. The burner according to claim 6, wherein said at least one neutralized segment occupies a concave part of said peripheral wall.

8. The burner according to claim 1, wherein said peripheral wall includes at least one convex segment.

9. The burner according to claim 8, wherein a majority of said ejection orifices are provided through a convex segment of said peripheral wall.

10. The burner according to claim 1, wherein said ejection axes are directed away from said peripheral wall.

11. The burner according to claim 1, wherein said peripheral wall is configured so that said wall is reachable at any periphery point by at least one finger of a hand, in particular for cleaning.

12. The burner according to claim 1, wherein at least one of said ejection orifices is connected to at least one neighboring ejection orifice by a flame duct.

13. The burner according to claim 12, wherein all said ejection orifices are connected to each other by a flame duct.

14. The burner according to claim 1, wherein said ejection axes are inclined in the same direction relative to a zone of said peripheral wall from which said ejection axes have respectively issued.

15. The burner according to claim 1, wherein said burner is an all-gas burner.

16. A cooking apparatus including at least one burner according to claim 1.

17. The cooking apparatus according to claim 16, wherein said burners are set in different orientations from each other around their respective vertical axes.

* * * * *

UNITED STATES PATENT AND TRADEMARK OFFICE

CERTIFICATE OF CORRECTION

PATENT NO. : 6,655,954 B2
DATED : December 2, 2003
INVENTOR(S) : Bernard Dane

It is certified that error appears in the above-identified patent and that said Letters Patent is hereby corrected as shown below:

Title page,
Item [73], delete "Sourdillion, Veigne (FR)" and insert -- Sourdillon, Veigne (FR) --

Signed and Sealed this

Thirteenth Day of April, 2004

JON W. DUDAS
*Acting Director of the United States Patent and Trademark Office*